US008251689B2

(12) United States Patent
Custer

(10) Patent No.: US 8,251,689 B2
(45) Date of Patent: Aug. 28, 2012

(54) ULTRAVIOLET LIGHT-EMITTING DIODE DEVICE

(75) Inventor: Eric J. Custer, Albion, IN (US)

(73) Assignee: Summit Business Products, Inc., Columbia City, IN (US)

( * ) Notice: Subject to any disclaimer, the term of this patent is extended or adjusted under 35 U.S.C. 154(b) by 1255 days.

(21) Appl. No.: 11/694,142

(22) Filed: Mar. 30, 2007

(65) Prior Publication Data

US 2007/0184141 A1 Aug. 9, 2007

Related U.S. Application Data

(63) Continuation-in-part of application No. 11/231,227, filed on Sep. 20, 2005, now Pat. No. 7,470,921.

(51) Int. Cl.
*G21G 1/12* (2006.01)

(52) U.S. Cl. ..... 425/174.4; 425/174; 425/501; 362/364; 362/227; 362/235; 362/800; 204/471; 204/478; 250/492.1; 250/503.1

(58) Field of Classification Search ..... 425/174, 425/174.4, 501; 362/362, 364, 227, 235, 362/241, 245, 247, 248, 800; 250/492.1, 250/454.11, 503.1, 504 R; 204/450, 471, 204/478; 156/331.1
See application file for complete search history.

(56) References Cited

U.S. PATENT DOCUMENTS 3,983,039 A * 9/1976 Eastland ..... 250/492.1
4,303,924 A * 12/1981 Young, Jr. ..... 347/102
4,644,899 A * 2/1987 Glaus ..... 118/642
4,672,258 A 6/1987 Konishi
5,216,283 A 6/1993 Lin
5,861,806 A 1/1999 Vories et al.
6,102,696 A 8/2000 Osterwalder
6,164,757 A * 12/2000 Wen et al. ..... 347/43
6,170,963 B1 1/2001 Arnold
6,543,890 B1 * 4/2003 Ylitalo et al. ..... 347/102
6,561,640 B1 5/2003 Young
6,621,087 B1 * 9/2003 Bisges et al. ..... 250/492.1
6,641,284 B2 11/2003 Stopa et al.
6,719,558 B2 4/2004 Cao
6,719,559 B2 4/2004 Cao (Continued)

FOREIGN PATENT DOCUMENTS

DE 202 01 493 5/2003

(Continued)

OTHER PUBLICATIONS

Translation of DE 202 01 493.

(Continued)

*Primary Examiner* — Joseph Del Sole
*Assistant Examiner* — Seyed Masoud Malekzadeh
(74) *Attorney, Agent, or Firm* — Senniger Powers LLP

(57) ABSTRACT

An ultraviolet (UV) light-emitting diode (LED) device for curing fluids such as inks, coatings, and adhesives, for example. In one embodiment, LEDs are positioned on faces defined by an inverted recess in a base portion. The LEDs are configured such that the light beams emitted from the LEDs converge at a single area or point to provide a single, focused area or point of amplified power from the LEDs. An optical culmination device may be used to further intensify the power output from the LEDs. The optical culmination device provides enhanced power output from the UV LED device which makes the curing process more efficient than previous curing systems.

6 Claims, 10 Drawing Sheets

U.S. PATENT DOCUMENTS

| | | | | |
|---|---|---|---|---|
| 6,739,716 | B2 | 5/2004 | Richards | |
| 6,755,649 | B2 | 6/2004 | Cao | |
| 6,783,227 | B2 | 8/2004 | Suzuki et al. | |
| 6,880,954 | B2 | 4/2005 | Ollett et al. | |
| 7,214,952 | B2 | 5/2007 | Klipstein | |
| 7,470,921 | B2 * | 12/2008 | Custer | 250/504 R |
| 2002/0101491 | A1 * | 8/2002 | Ervin et al. | 347/102 |
| 2002/0172916 | A1 | 11/2002 | Cao | |
| 2002/0177099 | A1 | 11/2002 | Cao | |
| 2003/0011669 | A1 * | 1/2003 | Tsuboi et al. | 347/102 |
| 2003/0035037 | A1 | 2/2003 | Mills et al. | |
| 2003/0184631 | A1 * | 10/2003 | Suzuki et al. | 347/102 |
| 2004/0135159 | A1 | 7/2004 | Siegel | |
| 2004/0164325 | A1 | 8/2004 | Siegel | |
| 2004/0166249 | A1 | 8/2004 | Siegel | |
| 2004/0170019 | A1 | 9/2004 | Tamai | |
| 2004/0179079 | A1 | 9/2004 | Yokoyama | |
| 2004/0238111 | A1 | 12/2004 | Siegel | |
| 2005/0042390 | A1 | 2/2005 | Siegel | |
| 2005/0068397 | A1 | 3/2005 | Yokoyama | |
| 2005/0093952 | A1 | 5/2005 | Hoshino | |
| 2005/0099478 | A1 | 5/2005 | Iwase | |
| 2005/0104946 | A1 | 5/2005 | Siegel | |
| 2005/0154075 | A1 | 7/2005 | Siegel | |
| 2005/0218468 | A1 | 10/2005 | Owen et al. | |
| 2005/0231983 | A1 | 10/2005 | Dahm | |
| 2005/0280683 | A1 | 12/2005 | Custer | |
| 2006/0275733 | A1 | 12/2006 | Cao | |
| 2007/0184141 | A1 | 8/2007 | Custer | |

FOREIGN PATENT DOCUMENTS

| | | | |
|---|---|---|---|
| EP | 1 428 668 | | 6/2004 |
| JP | 62159113 | A | 7/1987 |
| JP | 1163412 | A | 6/1989 |
| JP | 1274572 | A | 11/1989 |
| JP | 2001007406 | A | 1/2001 |
| JP | 2002153423 | A | 5/2002 |
| JP | 2002184209 | A | 6/2002 |
| JP | 2002314151 | A | 10/2002 |
| JP | 2002329893 | A | 11/2002 |
| JP | 2004181941 | A | 7/2004 |
| JP | 2004363352 | A | 12/2004 |
| JP | 2005104108 | A | 4/2005 |
| WO | 2004/011848 | | 2/2004 |
| WO | 2004011848 | A | 2/2004 |
| WO | 2004056581 | A1 | 7/2004 |
| WO | 2005/093858 | | 10/2005 |
| WO | 2008121808 | A1 | 10/2008 |

OTHER PUBLICATIONS

Product Information, Phoseon Technology, "Radion Solid State US—Transforming UV Technology", date unknown.

Product Information, UV Process Supply, Inc., "UV LED Cure-All", 2004.

Product Information, Norlux Corporation, "UV Markets", 2004.

Japanese Office action regarding Application No. 2006-252722 dated Feb. 20, 2009, 4 pages.

Office action dated Apr. 23, 2008 regarding U.S. Appl. No. 11/231,227, 24 pages.

* cited by examiner

ULTRAVIOLET LIGHT-EMITTING DIODE DEVICE

CROSS REFERENCE TO RELATED APPLICATIONS

This application is a continuation-in-part of U.S. patent application Ser. No. 11/231,227, filed on Sep. 20, 2005, now issued as U.S. Pat. No. 7,470,921 on Dec. 30, 2008 entitled ULTRAVIOLET LIGHT-EMITTING DIODE DEVICE, the disclosure of which is hereby expressly incorporated herein by reference.

BACKGROUND

1. Field of the Disclosure

The present disclosure relates to light-emitting diode devices and, more particularly, to ultraviolet light-emitting diode devices for use in curing fluids.

2. Description of the Related Art

In methods for ultraviolet (UV) curing of fluids including inks, coatings, and adhesives, the cured substance includes UV photo initiators therein which, when exposed to UV light, convert monomers in the fluids into linking polymers to solidify the monomer material. Conventional methods for UV curing employ UV light-emitting diodes (LEDs) and UV lamps to supply UV light for curing UV curable fluids on various products. However, these methods are often time-consuming and inefficient, thereby increasing difficulty and expense for curing UV curable fluids. For example, known UV LED fluid-curing devices require a large number of light emitting sources which not only add size and cost to a fluid-curing device, but also are inefficient in terms of power usage.

What is needed is an ultraviolet light-emitting diode device which is an improvement over the foregoing.

SUMMARY

The present disclosure relates to light-emitting diode devices. More particularly, the present disclosure relates to an ultraviolet (UV) light-emitting diode (LED) device for curing fluids such as inks, coatings, and adhesives, for example. In one embodiment, LEDs are positioned on faces defined by an inverted recess in a base portion. The LEDs are configured such that the light beams emitted from the LEDs converge at a single area or point to provide a single, focused area or point of amplified power from the LEDs. In another embodiment, the base portion is elongated to provide a single, focused line or region of amplified power from the LEDs. In one embodiment, the curing process occurs in an inert atmosphere. Because of the reduced number of light emitting sources required by the present disclosure, the size and cost of the UV LED device may advantageously be decreased. In one embodiment, a printed circuit is disposed in the base portion to provide power to the LEDs. All of the embodiments of the present disclosure advantageously reduce the amount of time required for curing the fluid and increase the efficiency of the curing process.

In another embodiment, an optical culmination device is used to further intensify the power output from the LEDs. The optical culmination device provides enhanced power output from the UV LED device which makes the curing process more efficient than previous curing systems.

In one form thereof, the present disclosure provides a system for curing a quantity of curable material, including a dispenser in communication with the quantity of curable material, the dispenser capable of dispensing a dispensed portion of the curable material; at least one light-emitting diode; and at least one optical culmination device positioned to intercept a light emitted from the at least one light-emitting diode and at least one of intensify and direct the light emitted from the at least one light-emitting diode to cure the dispensed portion of the curable material.

In another form thereof, the present disclosure provides a system for curing a quantity of curable material, including a dispenser in communication with the quantity of curable material, the dispenser capable of dispensing a dispensed portion of the curable material; at least one light-emitting diode; and culmination means for at least one of intensifying and directing a light emitted from the at least one light-emitting diode to cure the dispensed portion of the curable material.

In yet another form thereof, the present disclosure provides a system for curing a quantity of curable material, including a dispenser in communication with the quantity of curable material, the dispenser capable of dispensing a dispensed portion of the curable material; at least one light-emitting diode; and a base portion including a recess defining a plurality of faces, at least one light-emitting diode positioned on at least one of the faces, the faces configured to focus a light emitted from each at least one light-emitting diode to cure the dispensed portion of the curable material.

BRIEF DESCRIPTION OF THE DRAWINGS

The above mentioned and other features of this disclosure will become more apparent and will be better understood by reference to the following description of exemplary embodiments of the disclosure taken in conjunction with the accompanying drawings, wherein.

Figure 1:
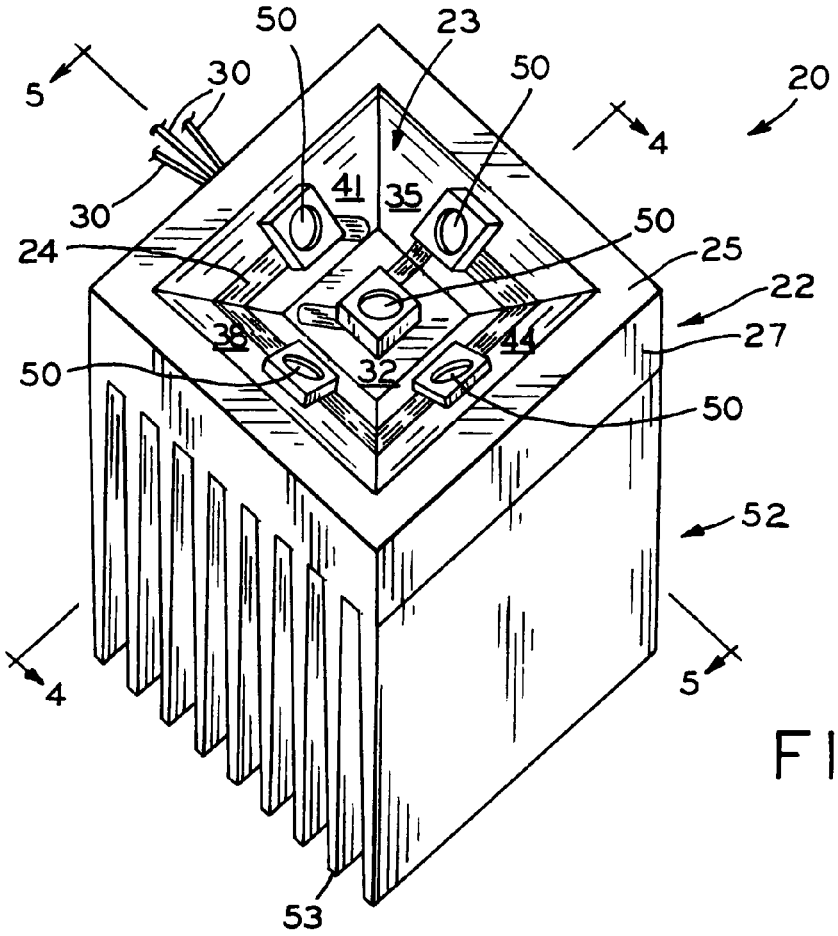
FIG. 1 is a perspective view of an LED device in accordance with the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the invention in any manner.

DETAILED DESCRIPTION

Figure 11:
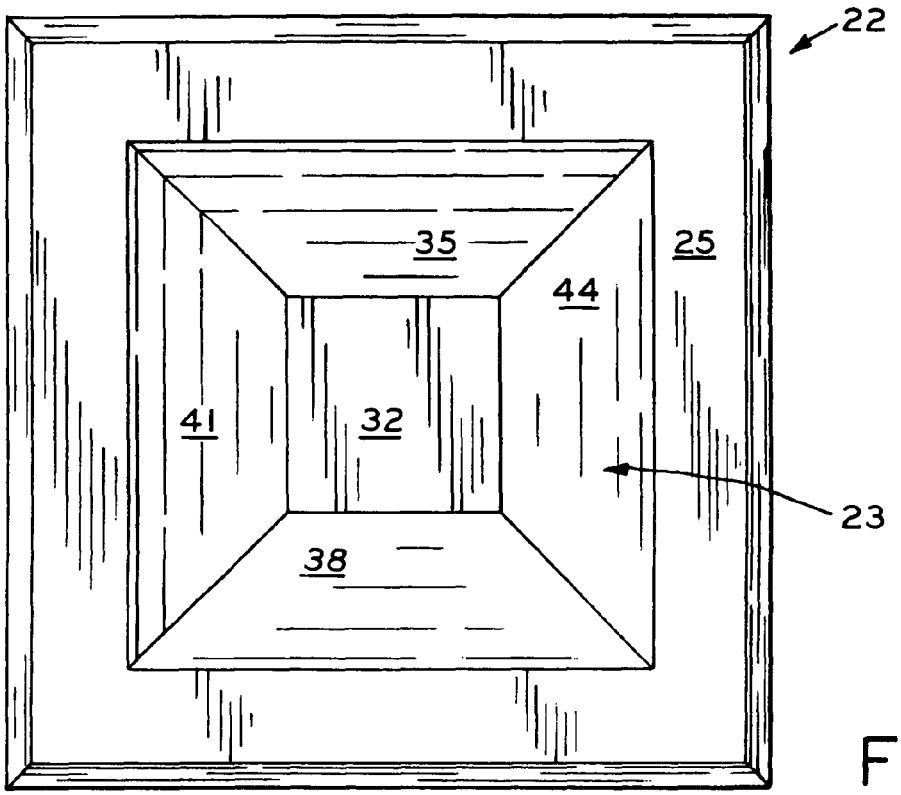
FIG. 11 is a bottom plan view of the device of FIG. 1, further illustrating the orientation of the faces without any apertures or LEDs attached thereto.

Referring to FIGS. 1 and 11, LED device base 22 is shown including bottom edge 25 and recess 23 including faces 32, 35, 38, 41, and 44. First face 32 is formed as a square-shaped face and each second face 35, 38, 41, and 44 is formed as a trapezoid-shaped face. In this way, recess 23 forms an inverted, pyramidal frustum-shaped recess comprised of four congruent trapezoidal-shaped faces 35, 38, 41, 44, and square face 32. Square or first face 32 may be the center face and trapezoidal or second faces 35, 38, 41, and 44 may be the angled faces of LED device 20. Base 22 may be formed of various materials, and, in one embodiment, base 22 is an aluminum block with recess 23 machined therein. Base 22 may be constructed of any heat-dissipating and thermally-conductive material, for example, aluminum, copper, brass, a thermally conductive polymer, cobalt, or a combination of any of the previous, e.g., aluminum combined with a thermally conductive polymer. Recess 23 may be formed through extrusion, milling, or injection-molding processes. Although edge 25 is defined as bottom edge 25, it is to be understood that the bottom side of LED device 20 is the side normally facing a substance to be cured. The bottom side of LED device 20 may be oriented in any configuration including facing sideways, upwards, or any angle therebetween depending on the orientation of the substrate upon which a curable substance is deposited.

Figure 10:
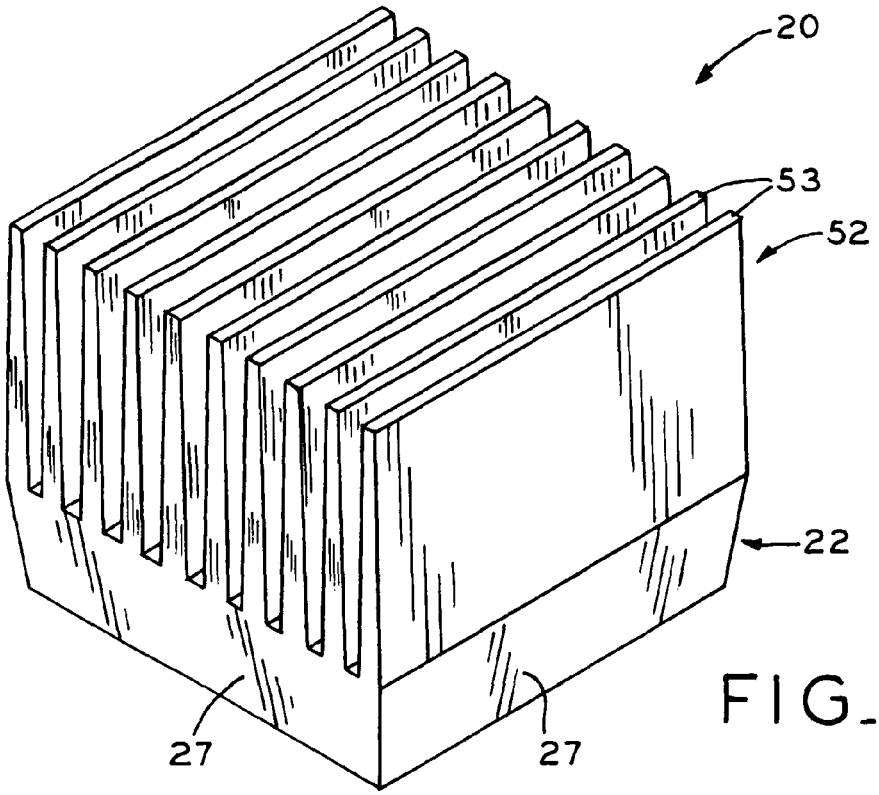
FIG. 10 is a perspective view of the top of the device of FIG. 1.

Referring now to FIGS. 1 and 10, base 22 may be integrally formed with heat sink 52 having heat sink fins 53 extending away from base 22. Thus, heat sink 52 and heat sink fins 53 are made of identical or substantially similar material as base 22. Alternatively, device 20 may not include heat sink 52 and instead be cooled with such methods as convection, liquid cooling, or gas cooling of device 20.

Figure 2:
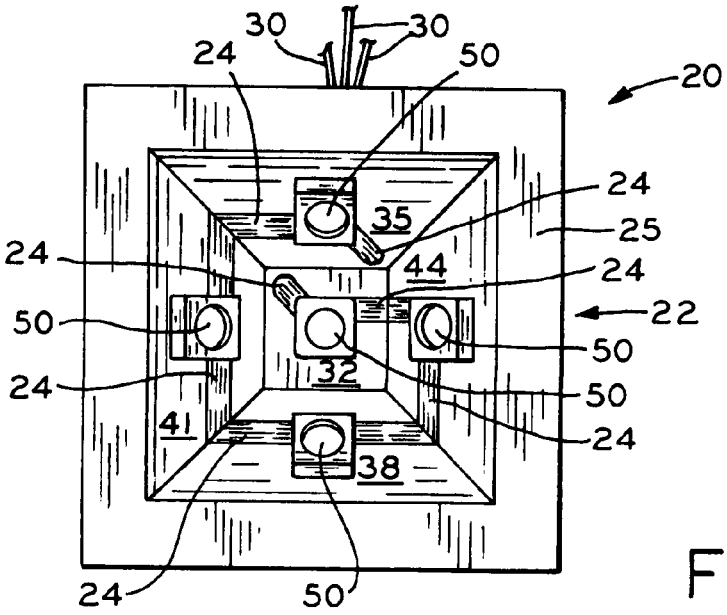
FIG. 2 is a bottom plan view of the device of FIG. 1.
Figure 3:
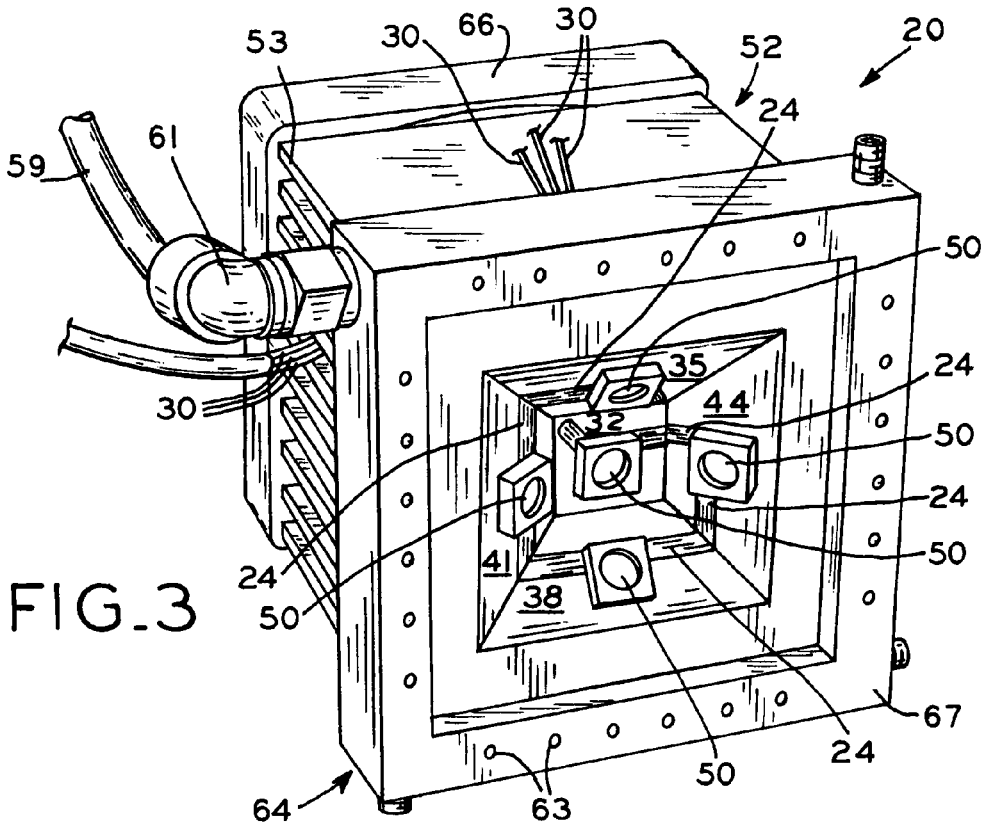
FIG. 3 is a perspective view of the LED device of FIG. 1, further illustrating a structure for supplying an inert atmosphere near the bottom of the LED device.
Figure 6:
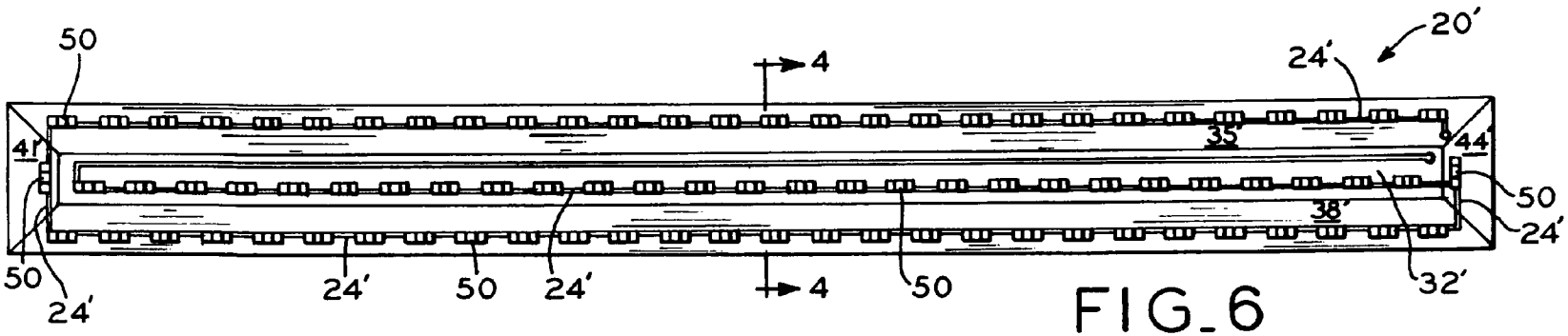
FIG. 6 is a bottom plan view of an alternative embodiment device in accordance with the present disclosure.

Referring now to FIGS. 1-3, LED device 20 includes base 22 with each face 32, 35, 38, 41, and 44 having LED 50 attached thereto. In one embodiment, LEDs 50 are centered on each respective face of base 22. In another embodiment, only some of faces 32, 35, 38, 41, and 44 have an LED 50 attached thereto. LEDs 50 are shown as relatively large, single point light sources, however, LEDs 50 may also be constructed of a plurality of point light sources (FIG. 6). Printed circuit 24 connects all five LEDs 50 and is connected to wires 30 which extend from base 22 to a power source (not shown) to provide power to LEDs 50. As shown in FIG. 3, wires 30 may be routed between heat sink fins 53 and then away from device 20 to connect to the power source. Printed circuit 24 may be formed directly in the material comprising base 22. LEDs 50 may be electrically interconnected via printed circuit 24 by any known interconnection method. In one embodiment, LEDs 50 may be UV LEDs to provide UV light for curing UV curable substances. UV LEDs 50 may be used to cure substances which include UV photo initiators contained therein which, when exposed to UV light, convert monomers in the substance into linking polymers to solidify the monomer material. In an alternative embodiment, LEDs 50 may include other types of LEDs such as visible light LEDs. In one exemplary embodiment, each LED 50 is a Part No. NCCU001 light-emitting diode, available from Nichia Corporation located in Japan.

As shown in FIG. 3, structure 64 may be used to provide an inert atmosphere in which to cure the fluids. The inert atmosphere advantageously removes oxygen from the curing area. During the curing process, the photo initiators in the curable fluid will take an oxygen atom from other chemicals in the fluid in order to solidify the monomer material. If the curing process takes place in an atmosphere which contains oxygen, the curing process is slowed because the photo initiators take oxygen atoms from the surrounding atmosphere instead of the fluid chemicals. If oxygen is removed from the curing area, the photo initiators must latch on to oxygen atoms in the fluids instead of oxygen atoms from the surrounding area, thereby increasing the speed of the curing process. Structure 64 includes a plurality of apertures 63 disposed on bottom surface 67 thereof. Nitrogen or another inert gas may be supplied to hose 59 and enter structure 64 via hose connection 61. The gas circulates throughout the hollow interior of structure 64 and exits via apertures 63 to essentially provide a curtain of inert gas. The curing process will then take place inside this curtained inert atmosphere.

In one embodiment, the inert gas may be provided via a nitrogen source (not shown) connected to hose 59 to supply nitrogen gas to structure 64. The nitrogen source may be a nitrogen tank or a nitrogen generator which essentially removes nitrogen from ambient air and pumps nitrogen gas into hose 59 for delivery to structure 64.

Figure 5:
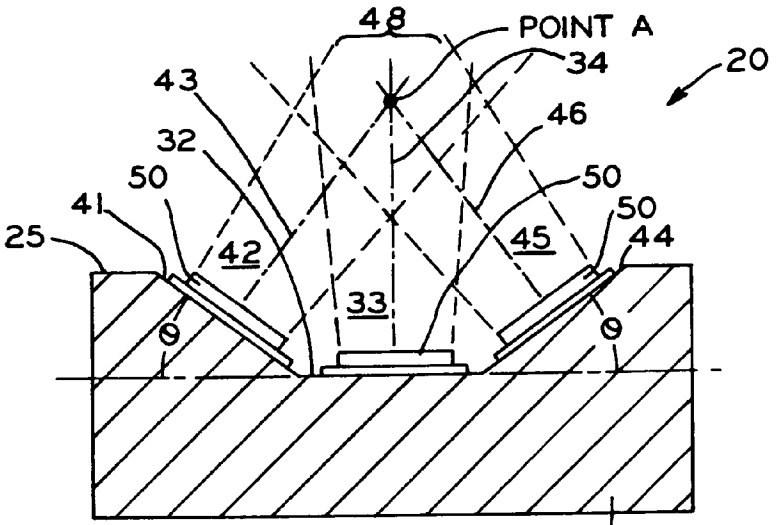
FIG. 5 is a cross-sectional view of the device of FIG. 1 taken along line 5-5 of FIG. 1, which is perpendicular to line 4-4.
Figure 4:
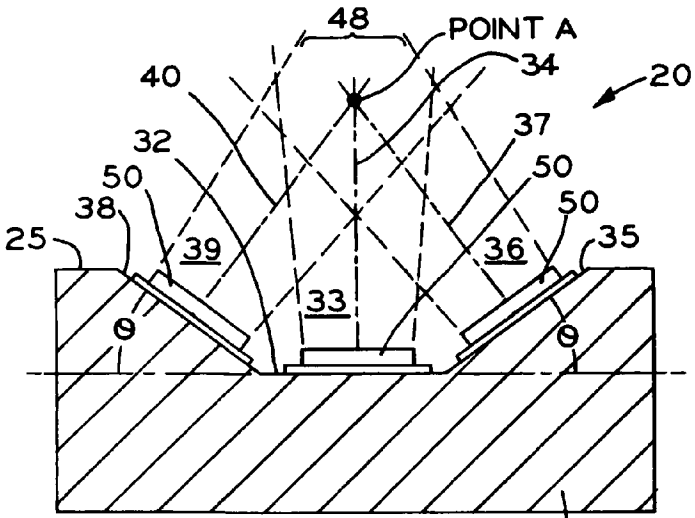
FIG. 4 is a cross-sectional view of the device of FIG. 1 taken along line 4-4 of FIG. 1.

Referring now to FIGS. 4 and 5, in one embodiment, faces 35 and 38 (FIG. 4) and faces 41 and 44 (FIG. 5) are angled such that light emitted from LED 50 on each respective face of base 22 converges at the same area or point, i.e., amplified area 48 or Point A. Faces 35, 38, 41, and 44 are all identically disposed at an angle $\theta$ with respect to a plane containing face 32. In one embodiment, angle $\theta$ is between 35° and 45°. In an alternative embodiment, angle $\theta$ is 36.7°. Various other measurements for angle $\theta$ may be chosen depending on the distance from device 20 to the substance to be cured. Additionally, the measurement of angle $\theta$ may vary depending on the dimensions of base 22, for example, if base 22 is widened, the measurements for angle $\theta$ would necessarily change to sustain the focused area or point of amplified power supplied by LEDs 50. Thus, angle $\theta$ could possibly measure anywhere between 0° and 90°.

As shown in FIG. 4, LED 50 on face 38 emits light beam 39, LED 50 on face 32 emits light beam 33, and LED 50 on face 35 emits light beam 36. Light beam 36, light beam 33, and light beam 39 intersect one another and produce amplified area 48 of focused and amplified light wherein light from all three beams 33, 36, and 39 converge. Amplified area 48 may be a single point of amplified and focused light or amplified area 48 may be a small localized area which is positioned on a surface of substrate 68 (FIG. 12) upon which ink or another UV-curable fluid is deposited. As shown in FIG. 5, LED 50 on face 41 emits light beam 42 and LED 50 on face 44 emits light beam 45 which intersect and converge with light beams 33, 36, and 39 to further add amplification and power to amplified area 48. Therefore, light emitted from all five LEDs 50 disposed on faces 32, 35, 38, 41, and 44 converge at amplified area 48 to provide a single, focused, and amplified area of power from LEDs 50, thereby advantageously providing a significantly increased power source at a single area or location.

As shown in FIGS. 4 and 5, each light beam emitted from LEDs 50 is in the general shape of a cone. The most intense light emitted from each LED 50 travels along a beam center line located in the exact center of the light cone, i.e., beam center lines 34, 37, 40, 43, and 46 for light beams 33, 36, 39, 42, and 45, respectively. The intensity of the light decreases moving away from the center of the beam towards the edge of the cone. As such, each beam center line meets at Point A which is the most focused and intense point of amplified light emitted from LEDs 50. The focused power from LEDs 50 may be arranged to provide a focused curing of a substance by positioning area 48 or Point A on the surface of a substrate containing a UV curable fluid. The focused area or point of amplified light reduces the likelihood of incomplete curing and increases the efficiency of the curing process because fewer LEDs need be employed. In one embodiment, Point A may be within amplified area 48.

Figure 7:
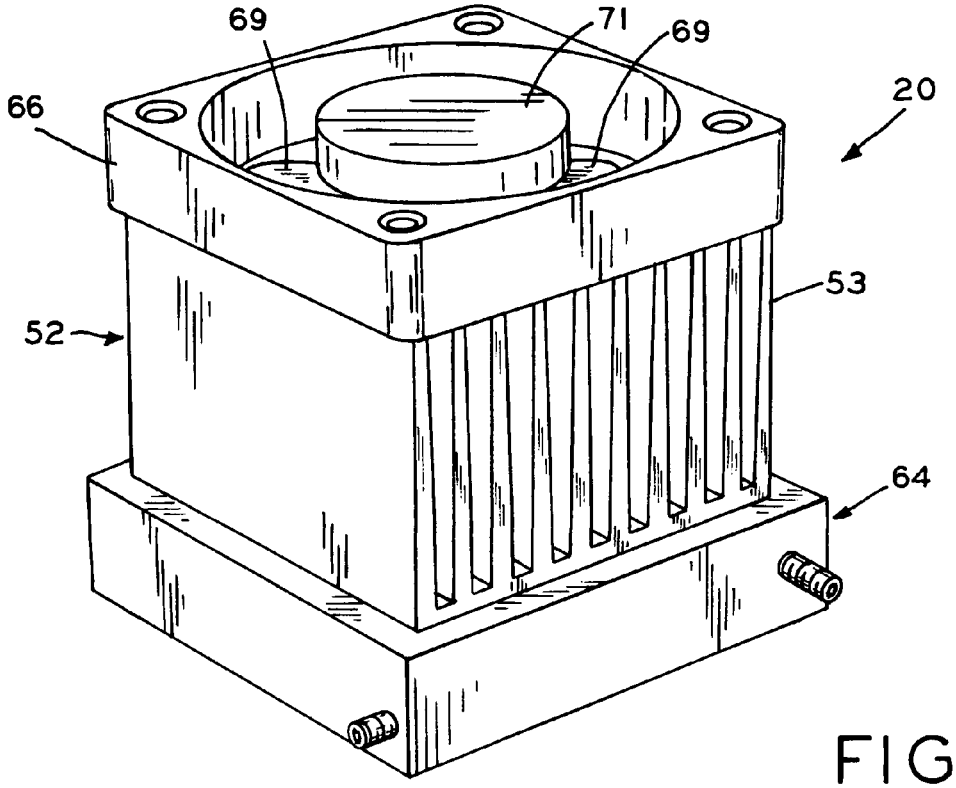
FIG. 7 is a perspective view of the device of FIG. 3.

Referring now to FIG. 7, device 20 is shown including heat sink 52 having heat sink fins 53 and structure 64 attached on a bottom side thereof. Axial fan 66 may be mounted on top of heat sink fins 53 to further facilitate removal of heat from base 22 generated by LEDs 50. Axial fan 66 may include motor 71 to drive blades 69.

Figure 12:
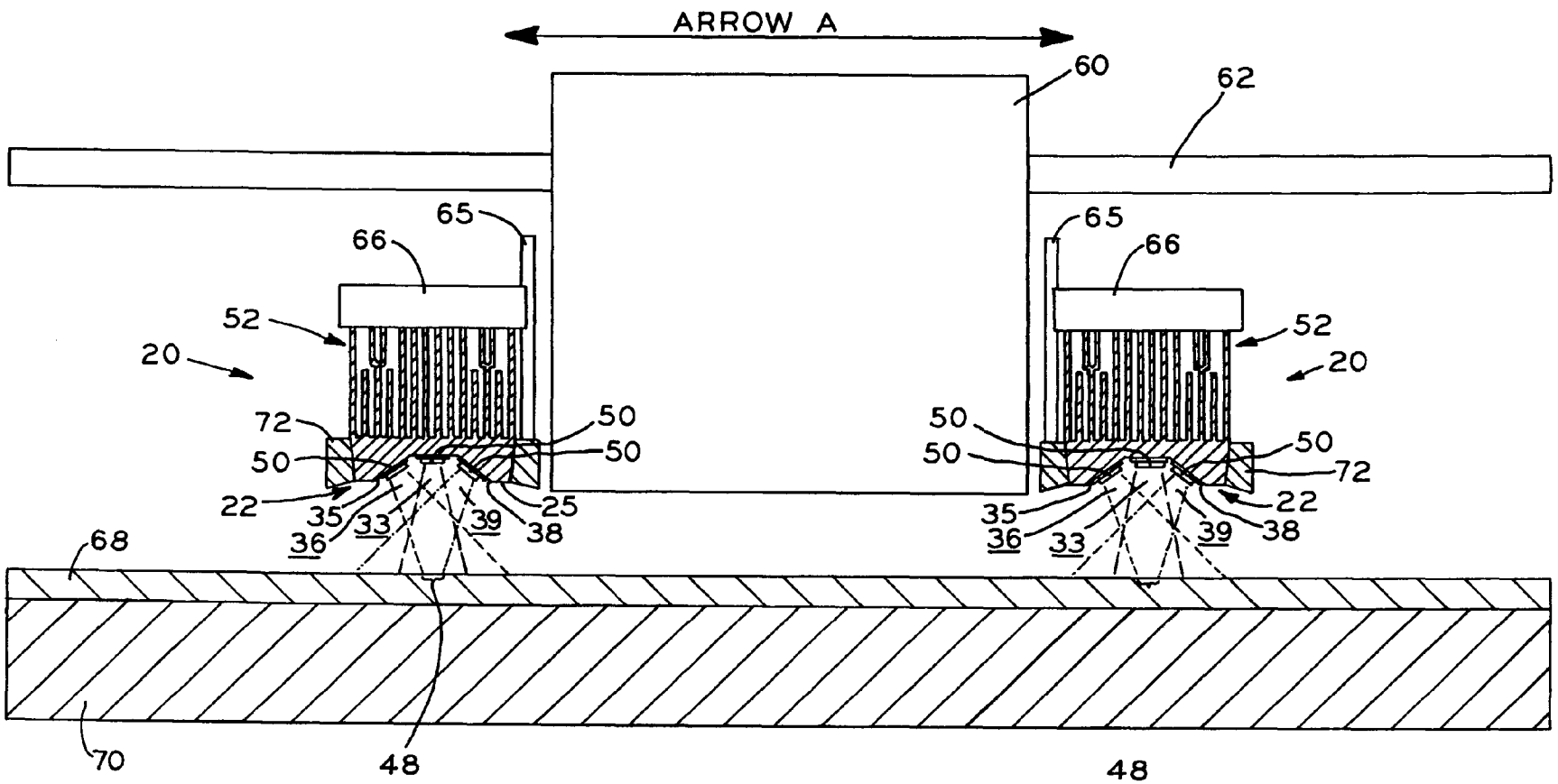
FIG. 12 is a plan view of a portion of a printer with the device of FIG. 1, further illustrating two devices disposed on opposite sides of a printing head.

Referring now to FIG. 12, a typical inkjet printer is shown including print head 60 which is capable of depositing fluid onto substrate 68. Print head 60 laterally moves along rail 62 in the directions defined by double-ended Arrow A. Device 20 is mounted on each side of print head 60 with heat sink 52 extending towards and connected to axial fan 66. Housings or structures 72 may also be provided to surround bases 22 of devices 20 and may be similar to structure 64 (FIGS. 3 and 7) described above. Tubes 65 may provide an inert gas, e.g., nitrogen, to housings 72, similar to hose 59 (FIG. 3) described above. The nitrogen gas in housings 72 may be used to create an inert gas curtain in which to cure the fluid deposited on substrate 68. For example, in one embodiment, the nitrogen gas may be released toward substrate 68 via a plurality of apertures 63 in the bottoms of housings 72 near substrate 68, similar to apertures 63 in structure 64 (FIG. 3) described above. Substrate 68 is supported by support structure 70 which may include a conveyor belt or other moving means capable of supporting and moving substrate 68.

In operation and as shown in FIG. 12, LED 50 on face 35 of base 22 emits light beam 36 towards substrate 68, LED 50 on face 32 emits light beam 33 towards substrate 68, and LED 50 on face 38 emits light beam 39 towards substrate 68. Light beam 36, light beam 33, and light beam 39 intersect one another and produce amplified area 48 of light on substrate 68 wherein light from all three beams 33, 36, and 39 converge. In an exemplary embodiment, amplified area 48 is positioned on a surface of substrate 68 upon which fluid is deposited by print head 60. As shown in FIG. 5 but not shown in FIG. 12, LED 50 on face 41 and LED 50 on face 44 also produce light beams 42 and 45, respectively, which converge with beams 33, 36, and 39 to add to amplified area 48 of focused and amplified light power.

Referring now to FIG. 6, an alternative embodiment LED device 20' is shown including faces 32', 35', 38', 41', and 44'. In one embodiment, each second or angled face 35', 38', 41', and 44' may include a substantially identical angled configuration with respect to a plane containing first or center face 32' as described above for faces 35, 38, 41, and 44 with respect to a plane containing face 32 (FIGS. 4 and 5). Faces 41' and 44' may, in one embodiment, be substantially similar in size and shape to faces 41 and 44, as described above, e.g., the parallel sides of faces 41' and 44' are substantially the same length as the parallel sides of faces 41 and 44. Faces 35' and 38', however, are not substantially congruent to faces 41' and 44'. Instead, faces 35' and 38' are extended along a length of device 20' and their parallel sides are of greater length than the corresponding parallel sides of faces 35 and 38. Faces 35' and 38' have a plurality of LEDs 50 positioned thereon in a straight line arrangement. Similarly, face 32' is extended along the length of device 20' and may be shaped as a rectangle with a plurality of LEDs 50 positioned thereon in a straight line arrangement. Faces 41' and 44' each also include LED 50 mounted thereon. Printed circuit 24' connects all LEDs 50 mounted on device 20' to a power source (not shown).

Light emitted from LEDs 50 on faces 32', 35', 38', 41', and 44' is directed in the same general direction as light emitted from LEDs 50 on faces 32, 35, 38, 41, and 44, as described above (FIGS. 4 and 5). The light emitted from LEDs 50 on faces 35' and 38' is substantially similar to light emitted from faces 35 and 38, as shown in FIG. 4. The primary difference as compared to device 20 is that device 20' has the ability to provide a line or extended region of focused and amplified power centered over face 32' as opposed to a single point or area of focused and amplified power as provided by device 20. In an alternative embodiment, only some of faces 32', 35', 38', 41', and 44' have an LED 50 attached thereto.

Figure 8:
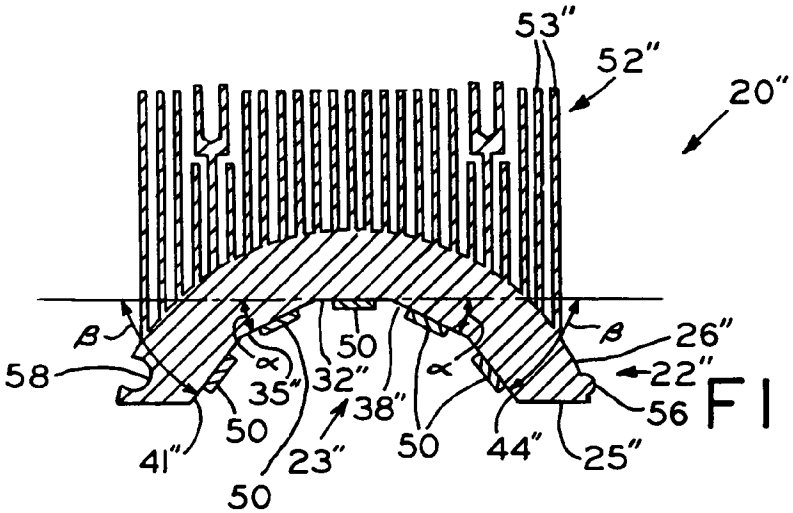
FIG. 8 is a cross-sectional view of the device of FIG. 9 taken along line 8-8.
Figure 9:
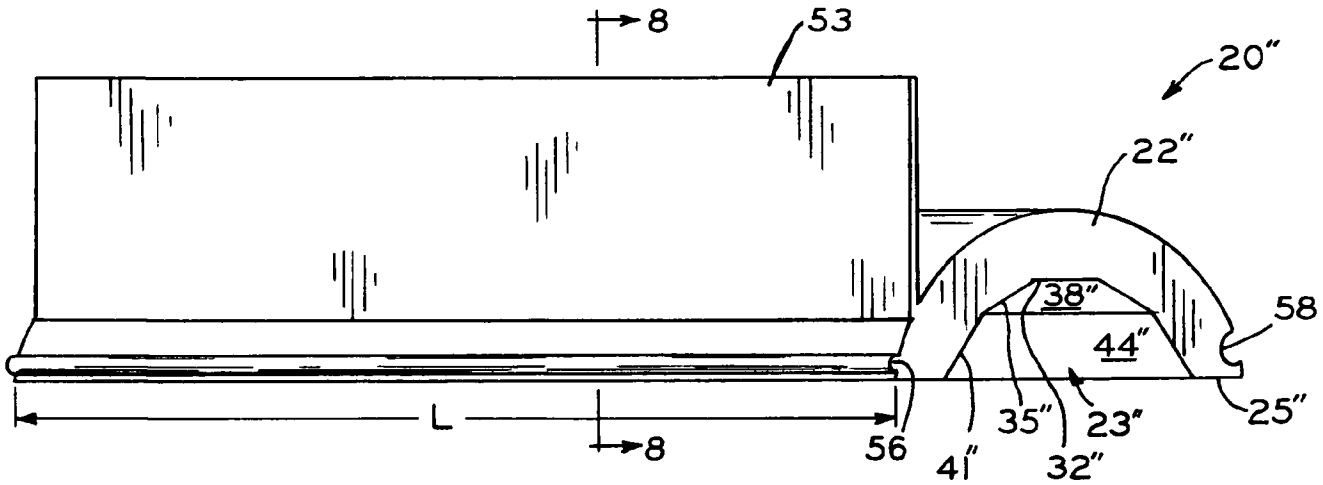
FIG. 9 is a perspective view of an alternative embodiment device according to the present disclosure.

Referring now to FIGS. 8 and 9, an alternative embodiment device 20" is shown including base 22" having bottom edge 25" and recess 23" with faces 32", 35", 38", 41", and 44". Heat sink 52" is disposed on top 26" of base 22" and, in one embodiment, heat sink 52" is integrally formed with base 22". In one embodiment, base 22" may include projection 56 and recess 58 to facilitate interconnection between adjacent bases 22" wherein projection 56 of one base 22" is shaped to mate with recess 58 of another base 22". All faces 32", 35", 38", 41", and 44" extend along longitudinal length L of base 22". Although not shown, LEDs 50 may be disposed along faces 32", 35", 38", 41", and 44" in a straight line arrangement on each respective face. In one embodiment, light emitted from LED 50 on each respective face converges along a line centered over center or first face 32", similar to device 20', as described above. In one embodiment, each base 22" may have length L which measures approximately 5 inches.

As shown in FIG. 8, angled or second faces 35" and 38" are disposed at first angle $\alpha$ with respect to a plane containing face 32". In one embodiment, first angle $\alpha$ is between 25° and 30°. In an alternative embodiment, first angle $\alpha$ is 26.9902°. As shown in FIG. 8, angled or third faces 41" and 44" are disposed at second angle $\beta$ with respect to a plane containing face 32". In one embodiment, second angle $\beta$ is between 50° and 60°. In an alternative embodiment, second angle $\beta$ is 53.9839°. Various other measurements for angle $\alpha$ and angle $\beta$ may be chosen depending on the distance from device 20" to the substance to be cured. Additionally, the measurements of angle $\alpha$ and angle $\beta$ may vary depending on the dimensions of base 22", for example, if base 22" is widened, the measurements for angle $\alpha$ and angle $\beta$ would necessarily change to sustain the focused area of amplified power supplied by LEDs 50. Thus, angle $\alpha$ and angle $\beta$ could possibly measure anywhere between 0° and 90°.

In an alternative embodiment, more than one device 20" may be employed in an end-to-end manner such as to lengthen the area of amplified power provided by LEDs 50 on device 20" and provide a modularized system. In such an embodiment, more than one power supply may need to be employed for each device 20", or, alternatively, a modified power supply could supply power to every device 20" in the arrangement. If more than one device 20" is employed, an inert atmosphere chamber (not shown) may be employed instead of the curtain-type inert atmosphere generation described above.

Although described throughout as having generally polygonal shapes, faces 32, 35, 38, 41, 44, as well as any alternative embodiments of these faces, may be formed into any which allows for the correct orientation of the LEDs 50, as described above.

In all of the above embodiments, LEDs 50 are driven by a power supply (not shown) which is capable of supplying constant current or adjustable pulsed current. LEDs 50 may be overdriven by the power supply to obtain greater power from LEDs 50. A control card may be employed to control the current supplied to LEDs 50. For example, one control card may control one device 20" (FIGS. 8-9) which may, in one embodiment, include 65 LEDs 50. In another example, one control card may control thirteen strings of five LEDs each.

Figure 13:
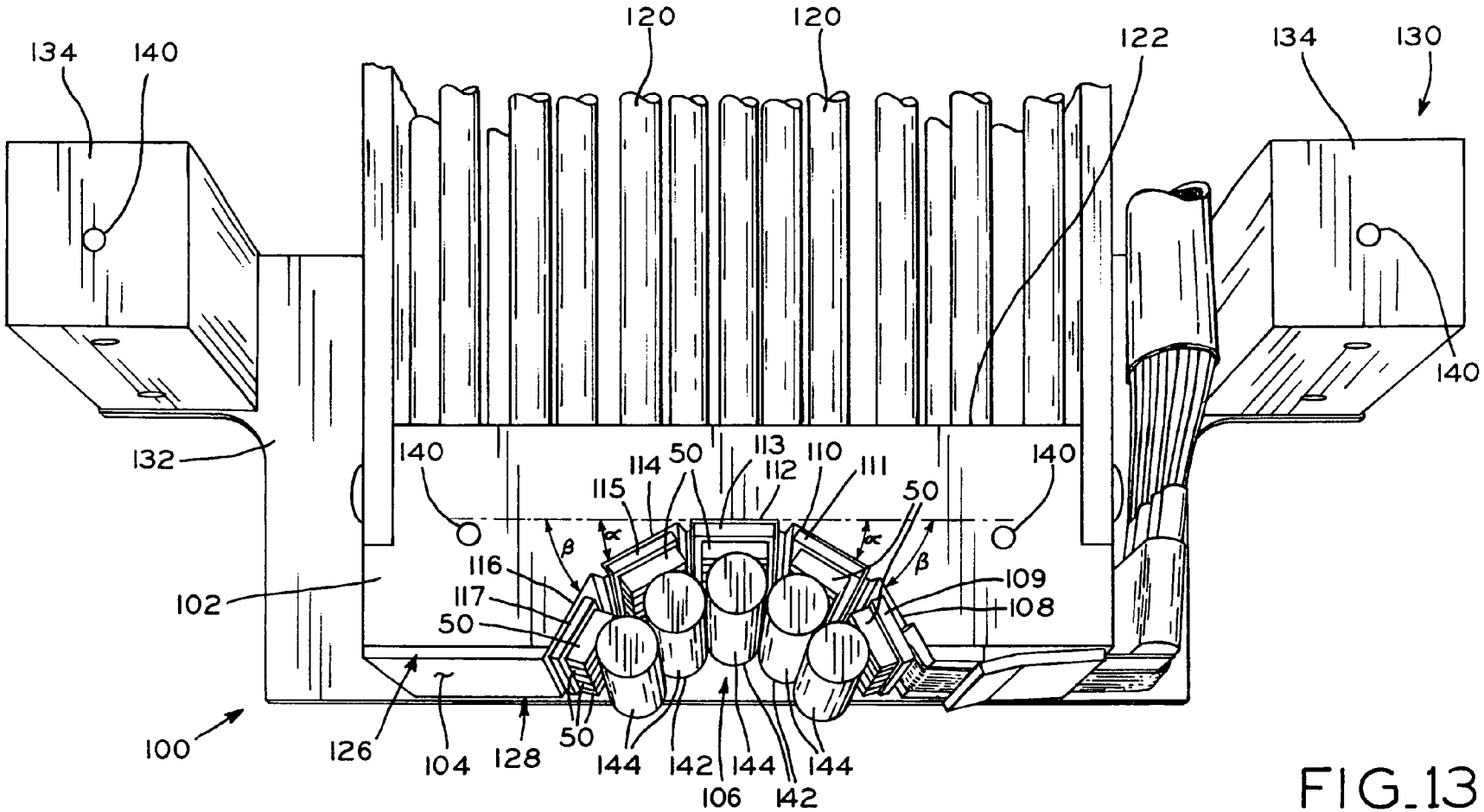
FIG. 13 is a perspective view of a portion of an LED device in accordance with another embodiment of the present disclosure.
Figure 14:
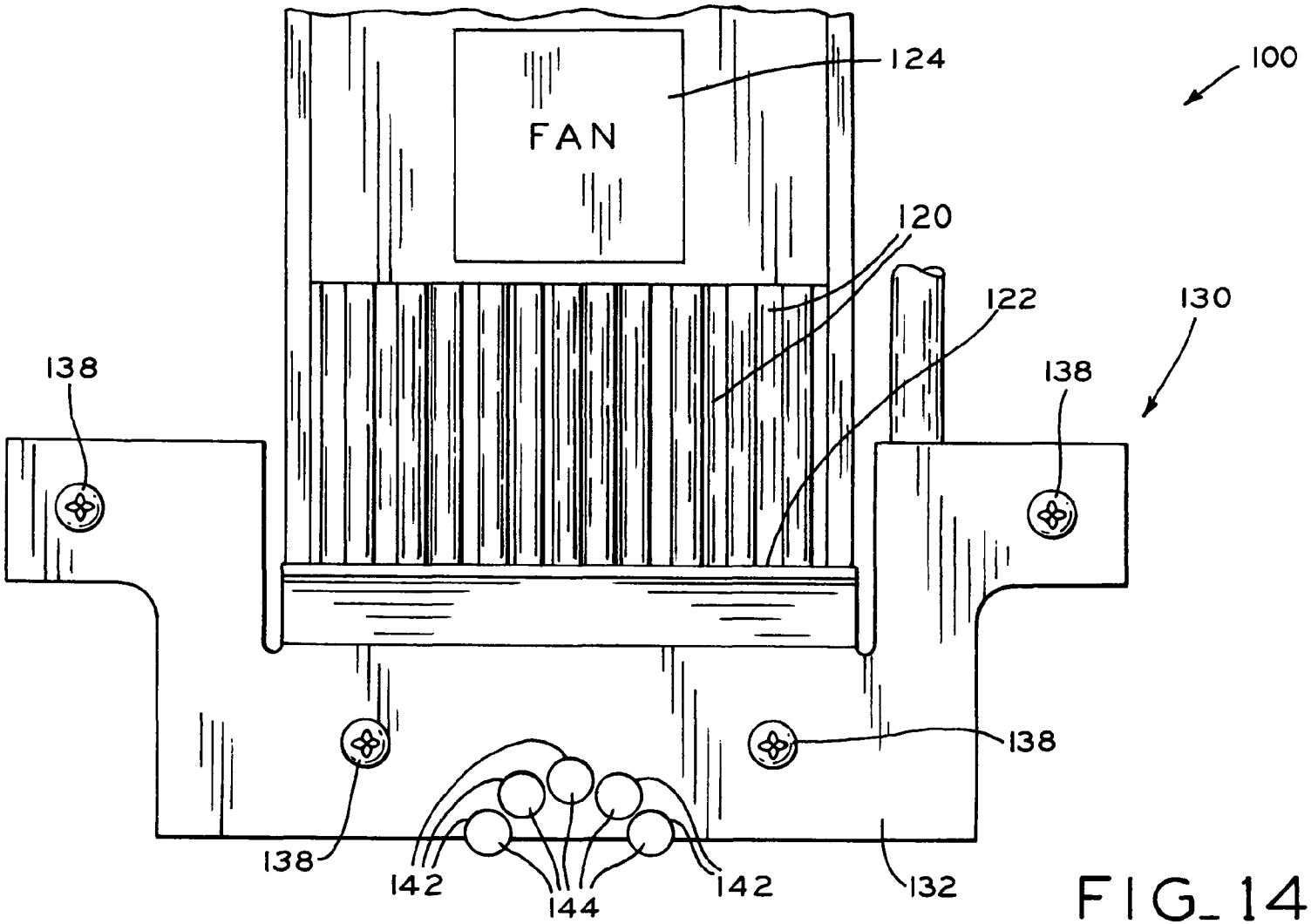
FIG. 14 is a plan view of a portion of the LED device of FIG. 13.

Referring now to FIGS. 13 and 14, an alternative embodiment device 100 is shown including base 102 having bottom edge 104 and recess 106 with faces 108, 110, 112, 114, 116. Faces 108, 110, 112, 114, 116 are generally planar faces and define two-dimensional planes in which each face extends. In an exemplary embodiment, faces 108, 110, 112, 114, 116 are generally rectangular-shaped and, therefore, are elongated in at least one of two dimensions in which the faces extend. Device 100 may be used for curing inks, as described above, and may further include any or all of the structure of any other embodiment disclosed herein. Base 102 is substantially identical to base 22, described above, except as described below. Each face may include a respective copper attachment strip 109, 111, 113, 115, 117 to which are attached a plurality of LEDs 50. Heat pipes 120 may extend from top 122 of base 102 and, in one embodiment, at least one of heat pipes 120 is directly attached to a copper attachment strip 109, for example. Heat pipes 120 may include a hollow, copper tube which is sealed on both ends and which includes a wicking material in a water-based solution. Heat pipes 120 may draw heat away from each copper attachment strip and fan 124 (FIG. 14) may be used to facilitate dispersement of heat drawn away from base 102 with heat pipes 120. Thus, heat pipes 120 may be used as an active cooling device in a forced air convection system.

All faces 108, 110, 112, 114, 116 extend along a longitudinal length of base 102. LEDs 50 may be disposed along faces 108, 110, 112, 114, 116 in a substantially straight line arrangement on each respective face. In one embodiment, light emitted from LEDs 50 on each respective face converges along a line centered over center or first face 112, similar to devices 20', 20", as described above. In one embodiment, each base 102 may have a length which measures approximately five inches. Base 102 further defines first end 126 and second end 128 between which the length extends.

As shown in FIG. 13, angled or second faces 110, 114 are disposed at first angle $\alpha$ with respect to a plane containing face 112. In embodiments, first angle $\alpha$ measures between approximately 5° to approximately 90°. First angle $\alpha$ can be as low as approximately 5°, 10°, 15°, 20°, or 25°, or as high as approximately 90°, 85°, 80°, 75°, 70°, 65°, 60°, 55°, 50°, 45°, 40°, 35°, or 30°, for example. In an exemplary embodiment, first angle $\alpha$ measures approximately 26.9902°. As shown in FIG. 13, angled or third faces 108, 116 are disposed at second angle $\beta$ with respect to a plane containing face 112. In embodiments, second angle $\beta$ measures between approximately 5° to approximately 90°. Second angle $\beta$ can be as low as approximately 5°, 10°, 15°, 20°, 25°, 30°, 35°, 40°, 45°, or 50°, or as high as approximately 90°, 85°, 80°, 75°, 70°, 65°, 60°, or 55°, for example. In an exemplary embodiment, second angle $\beta$ measures approximately 53.9839°. Various other measurements for angle $\alpha$ and angle $\beta$ may be chosen depending on the distance from device 100 to the substance to be cured. Additionally, the measurements of angle $\alpha$ and angle $\beta$ may vary depending on the dimensions of base 102. For example, if base 102 is widened, the measurements for angle $\alpha$ and angle $\beta$ may change to sustain the focused area of amplified power supplied by LEDs 50.

Referring again to FIGS. 13 and 14, device 100 further includes mounting structure 130 having plates 132 and optionally connecting bars 134. Mounting structure 130 is used to mount optical culmination devices 144 to device 100, as described below. Specifically, plates 132 are used to hold optical culmination devices 144 and connecting bars 134 connect plates 132 together between first end 126 and second end 128. Connecting bars 134 are not required and may be used in one embodiment to facilitate connection of plates 132 to each first end 126 and second end 128. Connecting bars 134 may be used to guide movement of device 100 along a track, such as a printing track, for example. One plate 132 is secured to second end 128 of base 102 via fasteners 138. Connecting bars 134 are then connected to plate 132 via fasteners 138. After positioning of optical culmination devices 144, as described below, the other plate 132 is then attached to first end 126 of base 102 and connecting bars 134 via fasteners 138 secured in receiving apertures 140 in base 102 and connecting bars 134.

Device 100 also includes at least one optical culmination device 144. Optical culmination device 144 does not form a part of each LED 50 and is to be distinguished from a lens component (not shown in detail) of each LED 50. Optical culmination device 144 may be formed as a cylinder, a semicylinder, or any portion of a cylinder. Optical culmination device 144 may be formed of suitable materials which transmit light waves therethrough, such as an acrylic material, a polymer material, a glass material, a ceramic material, or any combination of these materials, for example. In an exemplary embodiment, optical culmination device 144 may be formed as a clear cast acrylic rod having a diameter of approximately ⅜", available as Item No. 44600 from United States Plastic Corporation of Lima, Ohio. In an exemplary embodiment, optical culmination device 144 is formed as a cylinder or semicylinder having a diameter as low as approximately ⅛", ¼", ⅜", ½", ⅝", ¾", ⅞", or 1" or as high as approximately 2", 1⅞", 1¾", 1⅝", 1½", 1⅜", 1¼", or 1⅛", for example. Optical culmination device 144 is configured to culminate, i.e., intensify and climax, the light emitted from LEDs 50 of device 100. Optical culmination device 144 reorients light rays emitted from LEDs 50 from a continuously diverging pattern and causes the light rays to converge at a single area or point location at a specified distance from device 100. Device 144 may be configured to have this intensification area or point location occur at a desired distance, depending on the application of device 100.

In an exemplary embodiment, optical culmination device 144 may intensify and amplify power from LEDs 50 such that, prior to placement of optical culmination device 144, the power output of device 100 is approximately 730 mW/cm$^2$, and, subsequent to placement of optical culmination device 144, the power output of device 100 is as low as approximately 2.0, 2.2, 2.4, 2.6, 2.8, 3.0, or 3.2 W/cm$^2$ or as high as approximately 6.0, 5.7, 5.4, 5.0, 4.7, 4.5, 4.2, 4.0, 3.8, 3.6 or 3.4 W/cm$^2$, for example. Thus, substantially all light emitted from each LED 50 is captured by optical culmination device 144 and refracted so as to converge at a single location or area coincident with the light emitted from all LEDs 50 of device 100. In an exemplary embodiment, a power output of approximately 3.4 W/cm$^2$ is achieved at a distance from bottom edge 104 of base portion 102 of approximately ⅛", and is concentrated in an area having a length of approximately three inches and a width of approximately 3/32".

In an exemplary embodiment shown in FIG. 14, a plurality of optical culmination devices 144 are secured to device 100 via mounting structure 130. Each throughbore 142 in mounting structure 130 is formed in a shape complementary to a cross-sectional shape of each optical culmination device 144. For example, as shown in FIG. 14, throughbores 142 have a generally circular shape which is complementary to the generally cylindrical shape of each optical culmination device 144. To assemble mounting structure 130 and optical culmination devices 144 to device 100, one plate 132 is secured to second end 128 of base 102 via fasteners 138. Connecting bars 134 are then connected to plate 132 via fasteners 138. Optical culmination devices 144 are positioned in substantial alignment along each row of LEDs 50 on faces 108, 110, 112, 114, 116. Each optical culmination device 144 is located in a corresponding throughbore 142 of plate 132. The other plate 132 is then attached to first end 126 of base 102 and connecting bars 134 via fasteners 138. Each throughbore 142 of plate 132 is oriented to align with each optical culmination device 144. In an exemplary embodiment, the respective ends of each optical culmination device 144 extend substantially through throughbores 142 of plates 132 and are substantially flush with the outer surfaces of plates 132.

In alternative embodiments, optical culmination devices 144 may be used with any other embodiment LED device described herein, i.e., devices 144 may be sized to accommodate placement adjacent any LED 50 of any embodiment described herein. For example, devices 144 may be truncated such that devices 144 are able to be placed near LEDs 50 as shown in FIG. 1.

Figure 15:
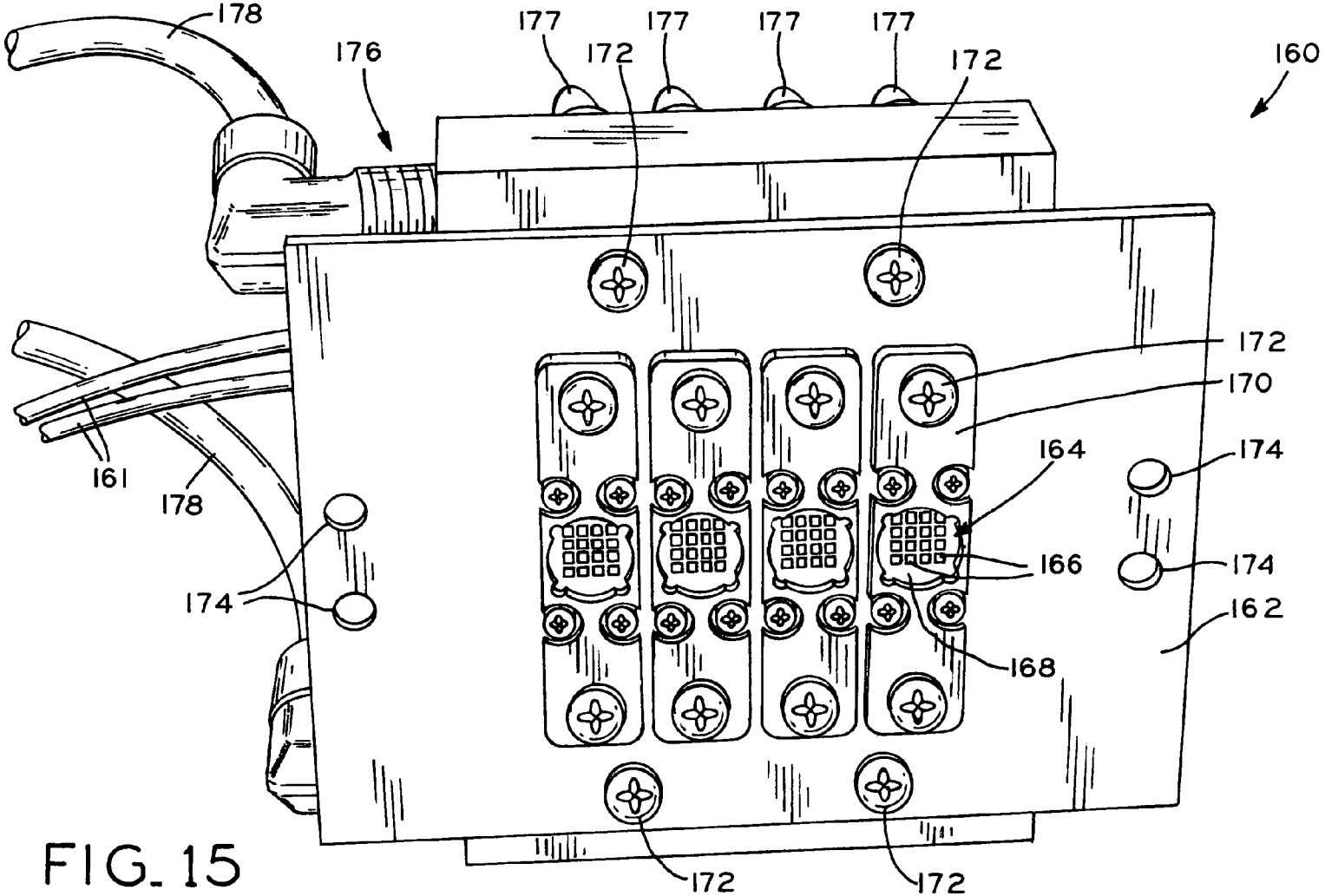
FIG. 15 is a perspective view of a portion of an LED device in accordance with yet another embodiment of the present disclosure.
Figure 16:
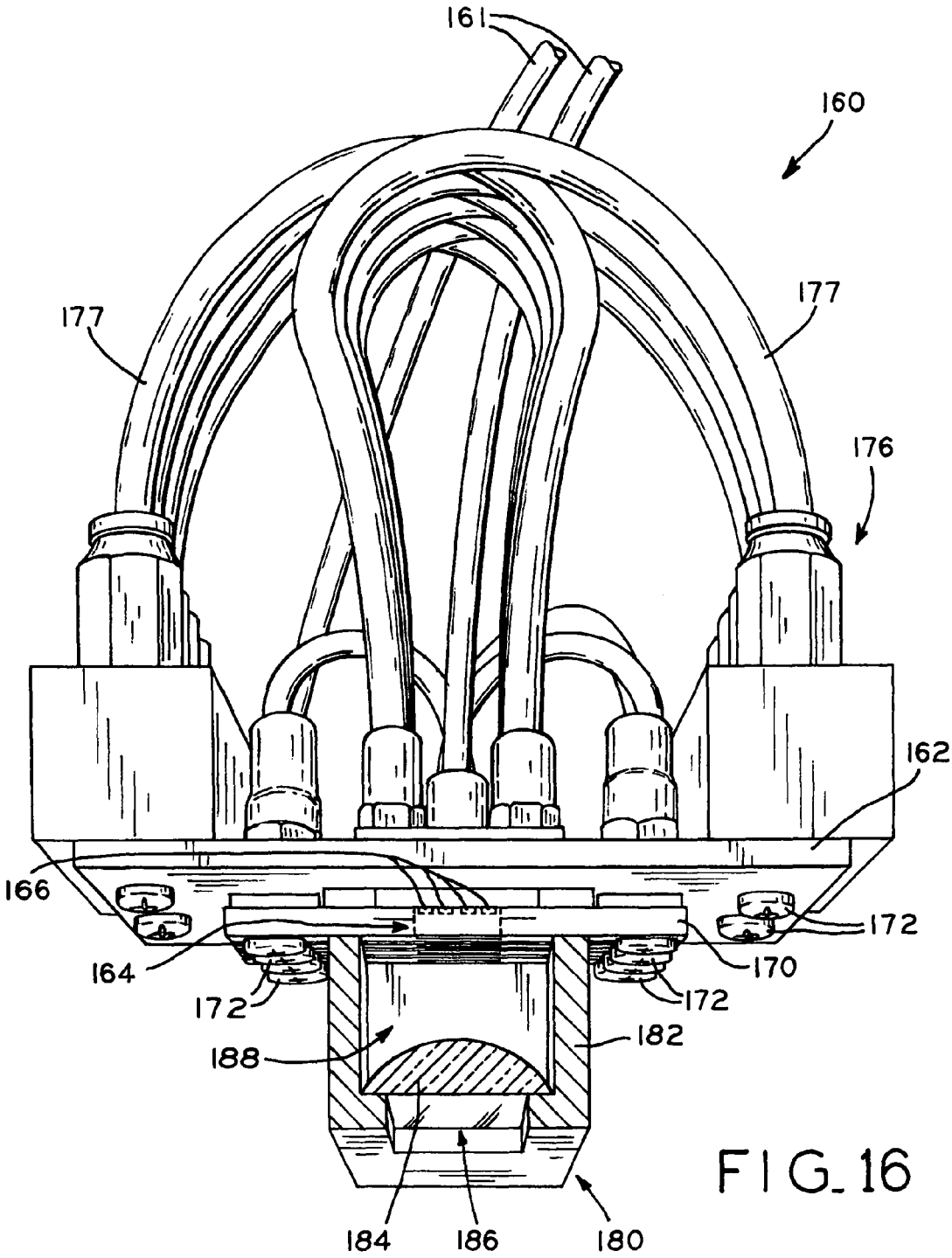
FIG. 16 is a partial sectional view of the LED device of FIG. 15.

Referring now to FIGS. 15 and 16, another alternative embodiment UV LED device 160 is shown and may include base portion 162 and a plurality of LED die packages 164. Device 160 may be used for curing inks, as described above, and may further include any or all of the structure of any other embodiment disclosed herein. Each LED die package 164 may include a plurality of LEDs 166, protective lens 168, and mount 170 for mounting LEDs 166 to base portion 162 via fasteners 172. LED die package 164 is generally available from Nichia Corporation of Japan. Device 160 also includes power cords 161 for supplying power to LEDs 166 and cooling device 176 for removing heat generated from LED die package 164 during use. Cooling device 176 may include a plurality of cooling hoses 177 and water supply hoses 178 for supplying water or other cooling solution from a source (not shown) to provide coolant for cooling device 176. Cooling device 176 may be mounted to base portion 162 via a plurality of fasteners 172. Base portion 162 includes a plurality of apertures 174 which are used for engagement with fasteners 172 to secure optical culmination device unit 180 to base portion 162.

Optical culmination device unit 180 includes mounting structure 182 and optical culmination device 184. Optical culmination device 184 is substantially identical to optical culmination device 144, described above. Mounting structure 182 may include cavity 188 and a plurality of apertures (not shown) for receiving fasteners 172 inserted through apertures 174 of base portion 162. Mounting structure 182 may also include longitudinal aperture 186 which extends along a length of mounting structure 182 at least a distance equal to the longitudinal length of which LED die packages 164 extend. In an exemplary embodiment, optical culmination device 184 may substantially cover aperture 186 such that any light emitted from LED die packages 164 must traverse optical culmination device 184 prior to exiting mounting structure 182 via aperture 186.

Optical culmination device 184 facilitates convergence of light emitted from LEDs 166 into a linear pattern similar to optical culmination device 144, described above, as opposed to a series of circular patterns as are emitted by LED die packages 164 without the aid of optical culmination device 184. Such a linear pattern advantageously permits further intensification of power from LEDs 166 in a desired region or point location.

Although illustrated in FIGS. 15 and 16 as arranged in a linear, planar manner, LED die packages 64 may be arranged on a plurality of faces of an inverted recess, as described above with any other embodiment described herein. Furthermore, a plurality of optical culmination devices 184 may be utilized in such a configuration, which may cause the power output of device 100 to be as low as approximately 5, 10, 15, 20, or 25 W/cm$^2$ or as high as approximately 50, 45, 40, 35, or 30 W/cm$^2$, for example.

While this disclosure has been described as having exemplary designs, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A system for curing a quantity of curable material, comprising:

a dispenser in communication with the quantity of curable material, said dispenser capable of dispensing a dispensed portion of the curable material;

a base portion including a recess defined by a plurality of planar faces including:

a central first face, a pair of second faces, each face of said pair of second faces extending from an opposite side of the first face and being disposed at a first angle with respect to said first face, and a pair of third faces, each face of said pair of third faces extending from a separate second face and being disposed at a second angle with respect to said first face different from the first angle;

a light-emitting diode mounted on one each of said first, second, and third faces; and a refractive optical culmination device positioned to intercept light emitted from each said light-emitting diode and to at least one of intensify and direct said light emitted from said light-emitting diode to cure said dispensed portion of the curable material.

2. The system of claim 1, wherein each said optical culmination device is positioned to intensify and direct said light emitted from said one light-emitting diode to cure said dispensed portion of the curable material.

3. The system of claim 1, wherein said optical culmination device is substantially aligned with one of said first, second, and third faces.

4. A system for curing a quantity of curable material, comprising:

a dispenser in communication with the quantity of curable material, said dispenser being capable of dispensing a dispensed portion of the curable material;

a base including a plurality of elongate faces, each of said elongate faces defining a longitudinal length extending in a longitudinal direction;

a plurality of light-emitting diodes, multiple diodes of said plurality of light-emitting diodes being mounted on each of said faces and being linearly arranged in the longitudinal direction thereof; and a plurality of elongate, cylindrical transparent optical culmination devices, each device being positioned to intercept light emitted from at least one light-emitting diode of said plurality of diodes and at least one of intensify and direct said light emitted from said at least one light-emitting diode as the intercepted light passes through the transparent optical culmination device to cure said dispensed portion of the curable material, each optical culmination device of said plurality of culmination devices extending in the longitudinal direction of the corresponding face and being substantially aligned with the respective multiple of light-emitting diodes mounted on said corresponding face.

5. The system of claim 1, further comprising a printer, said printer including said dispenser.

6. A system of claim 1 wherein said second angle is less than 90 degrees.

* * * * *